US005743186A

United States Patent [19]

Liao

[11] Patent Number: 5,743,186

[45] Date of Patent: Apr. 28, 1998

[54] STAMP

[76] Inventor: Shu Chiao Liao, No. 20, Alley 70, Lane 294, Sec. 4, Chung Kung Rd., Taipei, Taiwan

[21] Appl. No.: 783,495

[22] Filed: Jan. 14, 1997

[51] Int. Cl.[6] ..... B41K 1/42

[52] U.S. Cl. ..... 101/334; 101/104

[58] Field of Search ..... 101/327, 333, 101/334, 405, 406, 103, 104, 105, 106, 108

[56] References Cited

U.S. PATENT DOCUMENTS 5,152,223 10/1992 Marion ..... 101/334
5,359,932 11/1994 Van Breene ..... 101/334
5,517,916 5/1996 Dour et al. ..... 101/334
5,623,875 4/1997 Perets ..... 101/334

*Primary Examiner*—Edgar S. Burr
*Assistant Examiner*—Dave A. Ghatt

[57] ABSTRACT

A stamp including a casing, a spring supported actuating member moved in and out of the casing, a stamp plate moved with the casing relative to the actuating member and having a semi-circular gear at one end meshed with a longitudinal rack inside the actuating member, and an ink pad mounted inside the actuating member and disposed in contact with the stamping face of the stamp plate, wherein when the actuating member is pressed on a workpiece, the stamp plate is moved out of the bottom open end of the actuating member and turned through a 180° angle, causing the stamping face to be stamped on the workpiece.

1 Claim, 5 Drawing Sheets

STAMP

BACKGROUND OF THE INVENTION

The present invention relates to stamps, and more specifically to such a stamp which automatically applies an ink to the stamping face upon each stamping stroke.

When a stamp is used for marking a mark or pattern on documents, an ink pad shall be used to provide an ink to the stamp. If to mark a big volume of documents with a stamp, one shall have to repeatedly stamp the stamp on the ink pad and the documents, thereby causing the hand to ache. U.S. Pat. No. 4,432,281 discloses a stamp designed for a repeated stamping work. However, this structure of stamp is complicated and expensive. The stamping mechanism tends to be stuck during its operation.

SUMMARY OF THE INVENTION

It is one object of the present invention to provide a stamp which has self-provided ink means, and is suitable for a repeated stamping work. It is another object of the present invention to provide an auto-inking stamp which is inexpensive to manufacture. According to the preferred embodiment of the present invention, the stamp comprises a casing, a top cover covered on the top end of the casing, an actuating member moved in and out of the casing and coupled to the top cover by a spring, a stamp plate moved with the casing relative to the actuating member and having a semi-circular gear at one end meshed with a longitudinal rack inside the actuating member, and an ink pad mounted inside the actuating member and disposed in contact with the stamping face of the stamp plate. When the actuating member is pressed on a workpiece, the stamp plate is moved out of the bottom open end of the actuating member and turned through 180° angle, causing the stamping face to be stamped on the workpiece. On the contrary, when the actuating member is released from the workpiece, the actuating member is pushed out of the casing by the spring, and the stamping face of the stamp plate is turned reversely into close contact with the ink pad.

DETAILED DESCRIPTION OF THE PREFERRED EMBODIMENTS

Figure 1:
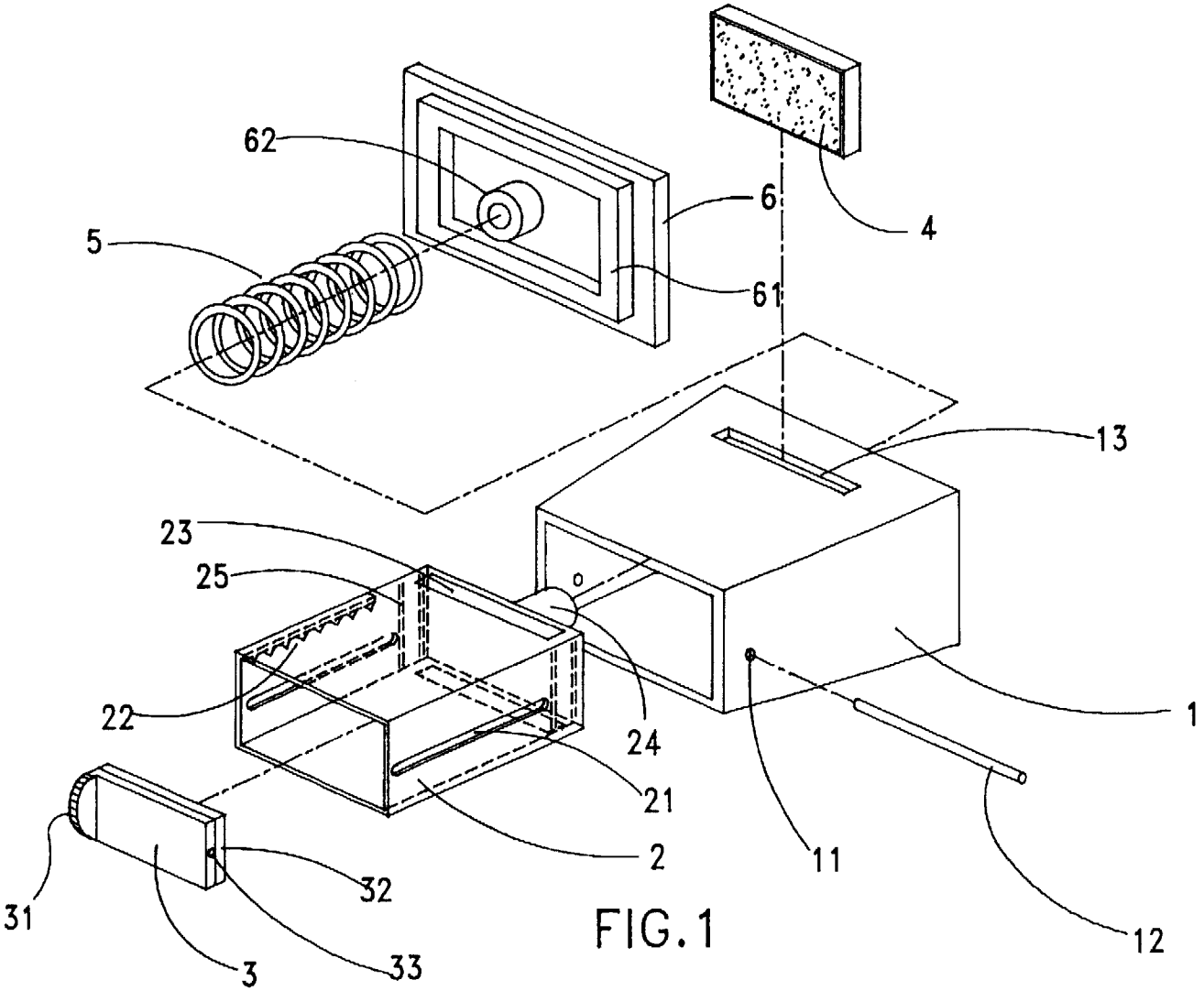
FIG. 1 is an exploded view of a stamp according to the present invention.
Figures 3, 6:
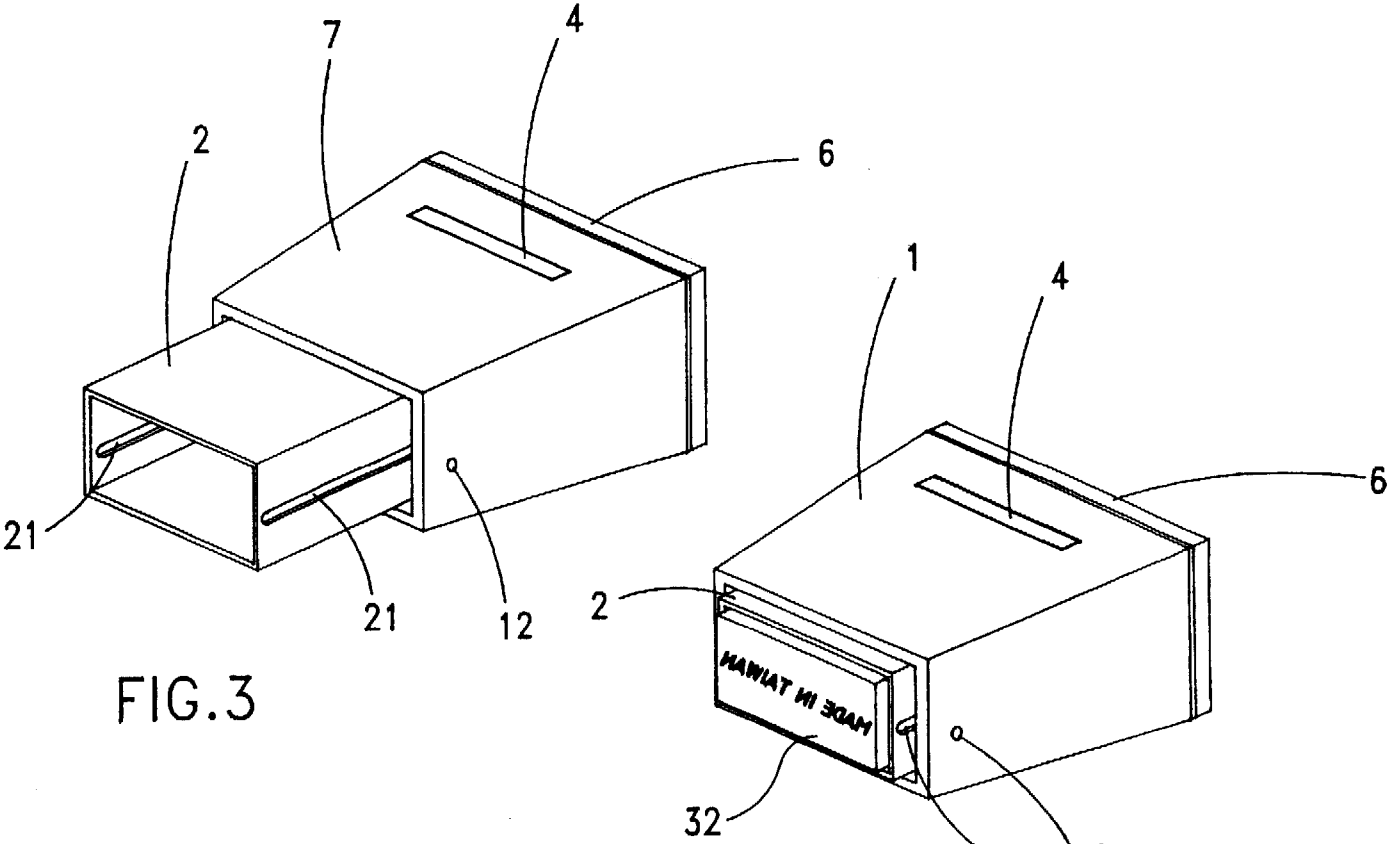
FIG. 3 is an elevational view of FIG. 2.
FIG. 6 is an elevational view of FIG. 5.

Referring to FIG. 1, a stamp in accordance with the present invention is generally comprised of a casing 1, an actuating member 2, a stamp plate 3, an ink pad 4, a spring 5, and a top cover 6. The casing 1 is a hollow, double open-end case, having two pivot holes 11 bilaterally aligned near the bottom, and a transverse insertion slot 13 at the front side near the top. The actuating member 2 is a bottom-open hollow shell moved in and out of the casing 1, having a longitudinal rack 22 on the inside, two longitudinal sliding slots 21 disposed at two opposite lateral sides, a stub rod 24 raised from the top, a transverse insertion slot 23 at the front side near the top, and two symmetrical inside flanges 25 bilaterally disposed on the inside adjacent two opposite ends of the transverse insertion slot 23. The stamp plate 3 comprises a semi-circular gear 31 at one end adapted for meshing with the longitudinal rack 22 of the actuating member 2, an axle hole 33 through the longitudinal central axis, and a stamping face 32 made with a mark (for example, MADE IN TAIWAN, as shown in FIG. 6). The top cover 6 has a bottom coupling flange 61 adapted for fitting into the top open end of the casing 1, and a downward stub rod 62 raised from the bottom side at the center. The spring 5 is adapted for coupling between the stub rod 24 of the actuating member 2 and the stub rod 62 of the top cover 6, to impart a downward pressure to the actuating member 2. The ink pad 4 is adapted for applying an ink to the stamping face 32 of the stamp plate 3.

Figure 2:
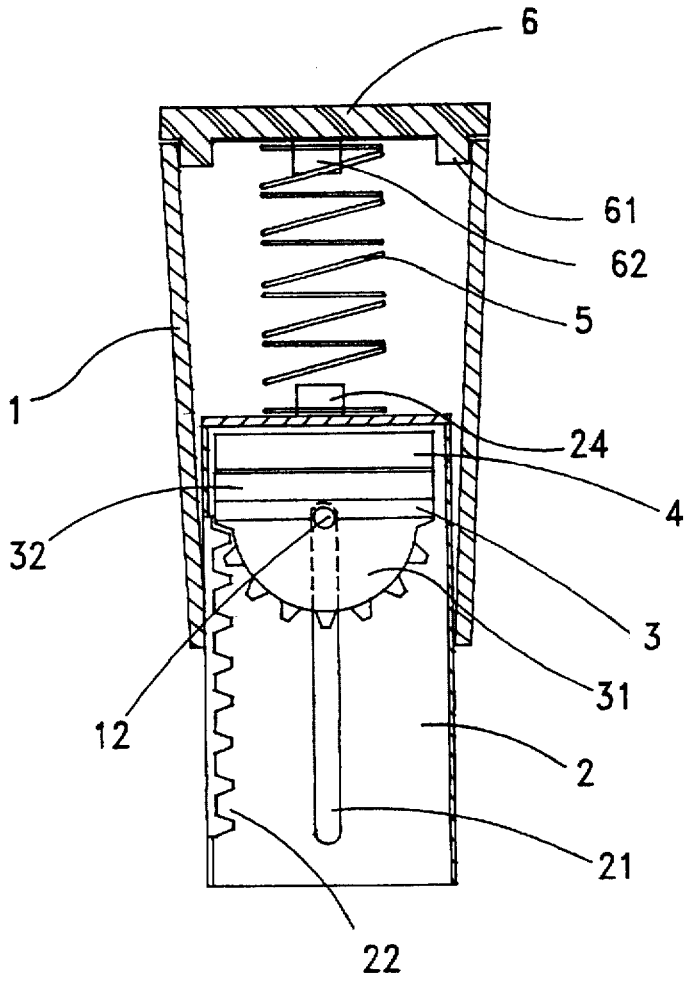
FIG. 2 is a sectional assembly view of the stamp shown in FIG. 1.

The assembly process of the stamp is outlined hereinafter with reference to FIGS. 1 and 2, the stamp plate 3 is inserted into the actuating member 2, permitting the semi-circular gear 31 to be forced into engagement with the longitudinal rack 22, then the actuating member 2 and the stamp plate 3 are coupled to the inside of the casing 1 by inserting a pivot 12 through the pivot holes 11 of the casing 1 into the longitudinal sliding slots 21 of the actuating member 2 and the axle hole 33 of the stamp plate 3, and then the ink pad 4 is inserted through the transverse insertion slot 13 of the casing 1 and the transverse insertion slot 23 of the actuating member 2 into the inside of the actuating member 2 and supported on the inside flanges 25, and then the bottom end of the spring 5 is coupled to the stub rod 24 of the actuating member 2, and then the stub rod 62 of the top cover 6 is coupled to the top end of the spring 5, and then the top cover 6 is fastened to the casing 1 by fitting the bottom coupling flange 61 into the top open end of the casing 1. When assembled, the spring 5 gives a downward pressure to the actuating member 2, causing the actuating member 2 to be pushed out of the bottom open end of the casing 1, and the ink pad 4 is disposed in contact with the stamping face 32 of the stamp plate 3 (see also FIG. 3).

Figure 4:
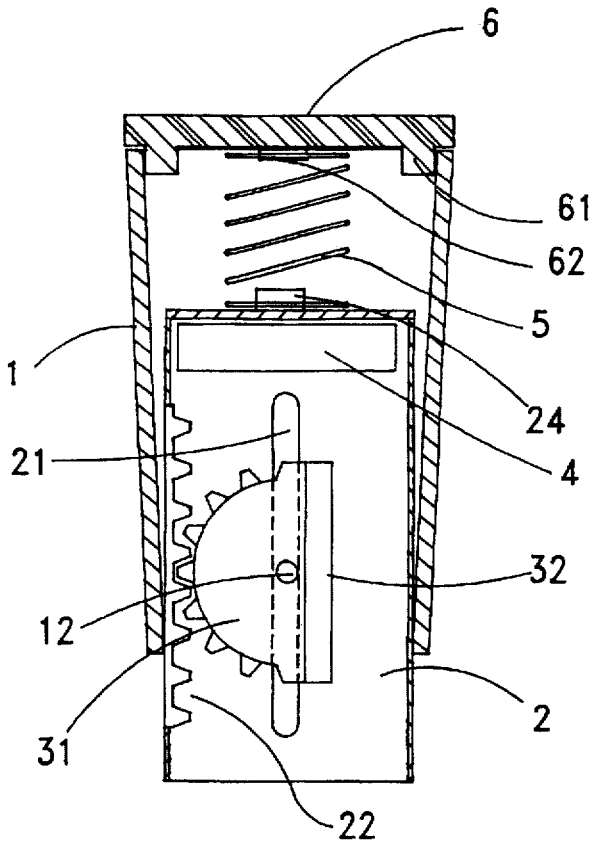
FIG. 4 is another sectional view of the present invention, showing the actuating member moved relative to the casing.
Figure 5:
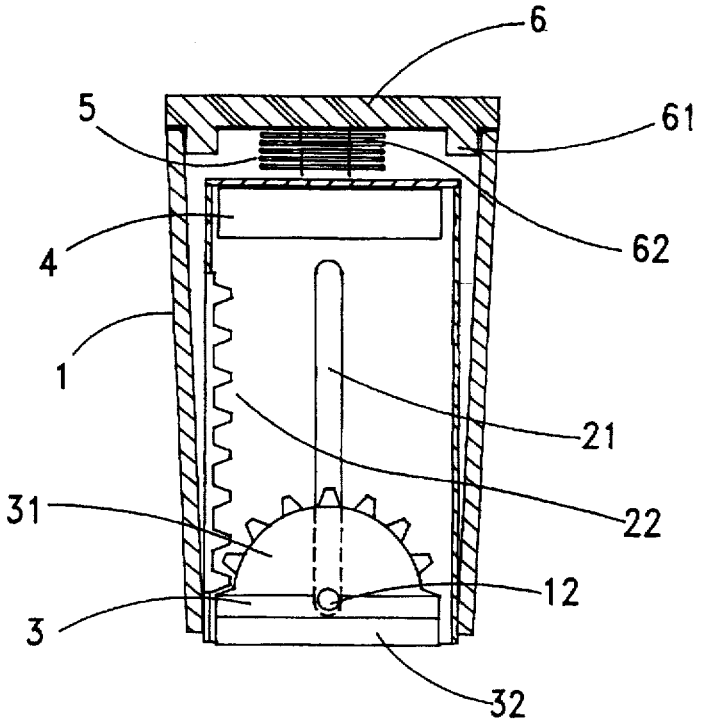
FIG. 5 is similar to FIG. 4 but showing the actuating member moved to the inside of the casing, and the stamping face of the stamp plate turned to the outside.

Referring to FIGS. 4, 5 and 6, when the actuating member 2 is pressed on for example a sheet of paper on a flat surface and the casing 1 is forced downwards relative to the actuating member 2, the stamp plate 3 is forced to turn through 180° angle (because the semi-circular gear 31 is meshed with the longitudinal rack 22), and therefore the stamping face 32 of the stamp plate 3 is turned to the outside and stamped on the sheet of paper. When the actuating member 2 is released from the sheet of paper, the spring 5 automatically pushes the actuating member 2 out of the casing 1, thereby causing the stamp plate 3 to be turned reversely to the inside, and therefore the stamping face 32 of the stamp plate 3 is turned back into close contact with the ink pad 4 again.

It is to be understood that the drawings are designed for purposes of illustration only, and are not intended as a definition of the limits and scope of the invention disclosed.

What the invention claimed is:

1. A stamp comprising:

a casing having a top open end, a bottom open end, two through holes bilaterally aligned near the bottom open end, and a transverse insertion slot at a front side thereof near the top open end;

a pivot connected between the through holes of said casing;

an actuating member moved in and out of the bottom open end of said casing, said actuating member comprising a bottom open end, a closed top end, a longitudinal rack on the inside, two longitudinal sliding slots disposed at two opposite lateral sides through which said pivot passes, a stub rod raised from the closed top end, a transverse insertion slot at a front side thereof near the closed top end, and two symmetrical inside flanges bilaterally disposed on the inside adjacent to the closed top end;

a stamp plate turned about said pivot within a 180° angle and moved in and out of the open bottom end of said actuating member, said stamp plate comprising a semi-circular gear at one end meshed with the longitudinal rack of said actuating member, an axle hole which receives said pivot, and a stamping face made with a mark for stamping;

a top cover covered on the top open end of said casing, said top cover having a bottom coupling flange fitted into the top open end of said casing and a downward stub rod raised from a bottom side thereof;

spring means connected between the stub rod of said actuating member and the stub rod of said top cover to impart a downward pressure to said actuating member; and an ink pad inserted through the transverse insertion slot of said casing and the transverse insertion slot of said actuating member and held inside said actuating member in contact with the stamping face of said stamp plate by the inside flanges of said actuating member;

wherein when said actuating member is pressed on a workpiece and said casing is pressed down relative to said actuating member, the stamping face of said stamp plate is turned out of the bottom open end of said actuating member and stamped on the workpiece.

* * * * *